US008810336B2

(12) United States Patent
Subedi

(10) Patent No.: US 8,810,336 B2
(45) Date of Patent: Aug. 19, 2014

(54) REDUCED SIZE CAVITY FILTERS FOR PICO BASE STATIONS

(75) Inventor: Purna C. Subedi, Irvine, CA (US)

(73) Assignee: Powerwave Technologies S.A.R.L., Luxembourg (LU)

( * ) Notice: Subject to any disclaimer, the term of this patent is extended or adjusted under 35 U.S.C. 154(b) by 389 days.

(21) Appl. No.: 13/078,736

(22) Filed: Apr. 1, 2011

(65) Prior Publication Data

US 2011/0241801 A1 Oct. 6, 2011

Related U.S. Application Data

(60) Provisional application No. 61/321,488, filed on Apr. 6, 2010.

(51) Int. Cl.
*H01P 1/202* (2006.01)
*H01P 7/04* (2006.01)
*H01P 1/205* (2006.01)

(52) U.S. Cl.
CPC ..... *H01P 1/2053* (2013.01); *H01P 7/04* (2013.01)
USPC ..... 333/203; 333/223

(58) Field of Classification Search
CPC ..... H01P 1/2053; H01P 7/04; H01P 7/06
USPC ..... 333/134, 219, 202–212, 222, 223
See application file for complete search history.

(56) References Cited

U.S. PATENT DOCUMENTS 4,292,610 A * 9/1981 Makimoto et al. ..... 333/222
4,985,690 A * 1/1991 Eguchi et al. ..... 333/222
5,039,966 A * 8/1991 Schmid et al. ..... 333/229
5,905,416 A * 5/1999 Schmid et al. ..... 333/134
5,959,512 A 9/1999 Sherman
6,114,928 A * 9/2000 Smith ..... 333/202
2003/0169131 A1* 9/2003 Haapakoski ..... 333/222
2004/0027211 A1* 2/2004 Yi ..... 333/99 S
2006/0038640 A1 2/2006 D'Ostilio
2006/0181870 A1 8/2006 Sharrah et al.
2006/0254045 A1* 11/2006 Haapalahti et al. ..... 29/594

(Continued)

OTHER PUBLICATIONS

International Preliminary Report on Patentability for International Application No. PCT/US2011/030987 dated Oct. 18, 2012, 8 pages.

(Continued)

*Primary Examiner* — Benny Lee
*Assistant Examiner* — Rakesh Patel
(74) *Attorney, Agent, or Firm* — Caseiro Burke LLC; Chris A. Caseiro

(57) ABSTRACT

An improved microwave cavity filter used in cellular communication systems such as base stations is disclosed. The cavity filter has a conductive housing forming a cavity therein and a hollow conductive resonator configured in the cavity with a folded hat shaped upper portion. A tuning screw extends from the top cover of the housing into the top folded hat portion of the hollow resonator to fine tune the resonator. The resonator also may preferably include two different diameter sections providing a first high impedance section with smaller diameter and a second lower impedance section with a larger diameter configured at an upper end of the resonator. This configuration provides a significantly smaller cavity height for a given power handling capability. The resonator is preferably of constant thickness allowing low cost stamping or other forming techniques to be used in forming the resonator.

12 Claims, 7 Drawing Sheets

(56) References Cited

U.S. PATENT DOCUMENTS

2006/0284708 A1 12/2006 Reeves
2008/0246561 A1 10/2008 Blair et al.
2009/0256652 A1 10/2009 Salehi et al.
2010/0265015 A1* 10/2010 Hoeft et al. ..... 333/219.1

OTHER PUBLICATIONS

International Search Report and Written Opinion for International Application No. PCT/US2011/030987 dated Jun. 21, 2011, 9 pages.

* cited by examiner

Fig 4A
Prior Art
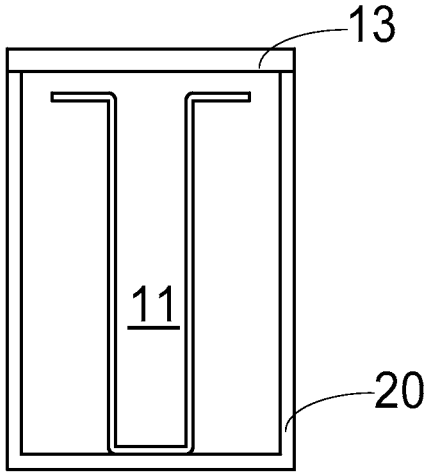
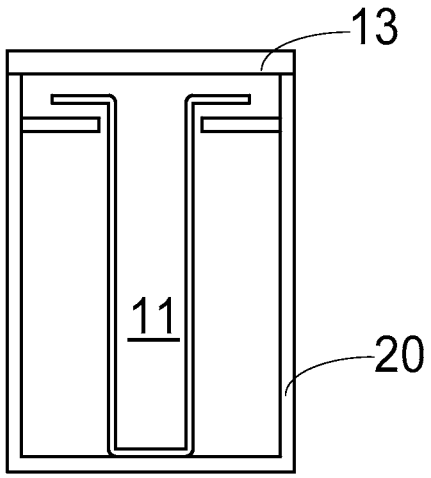
Fig 4B
Prior Art

Prior Art

Fig 6A
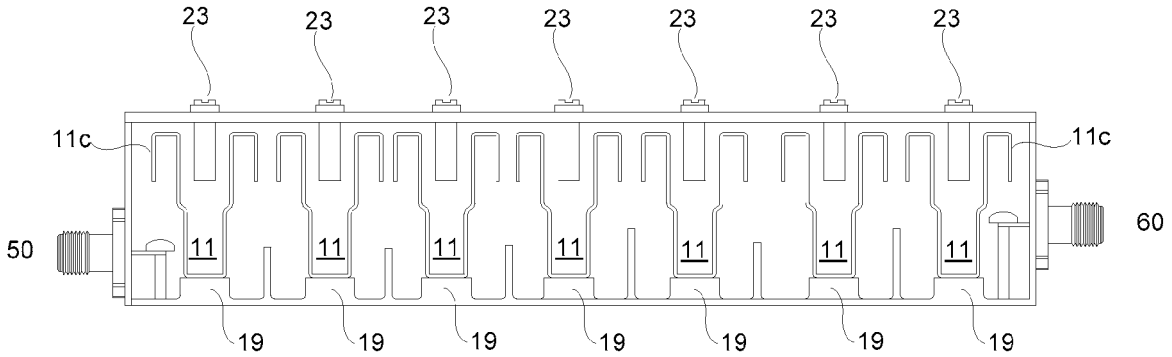
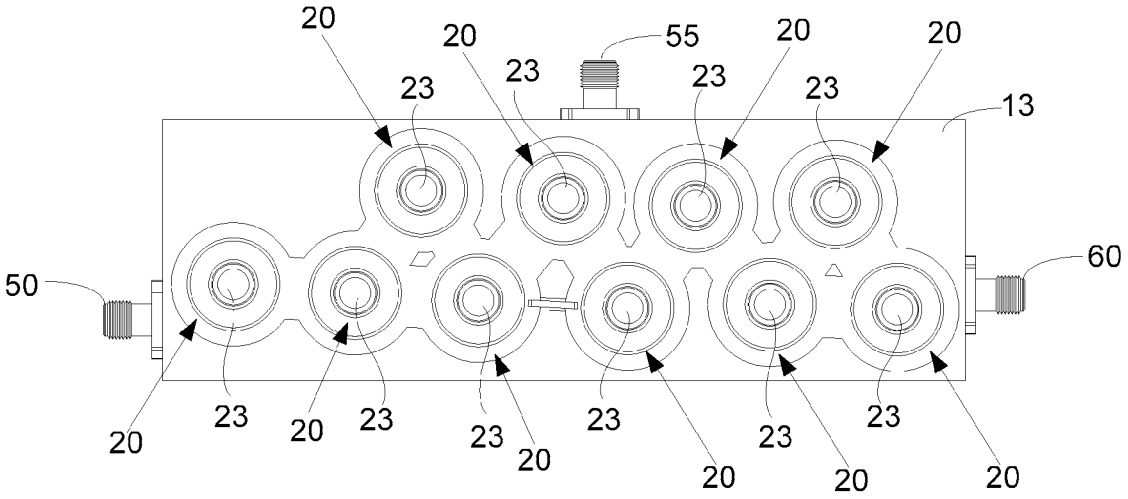
Fig 6B

REDUCED SIZE CAVITY FILTERS FOR PICO BASE STATIONS

RELATED APPLICATION INFORMATION

The present application claims the benefit under 35 USC 119(e) of provisional patent application Ser. No. 61/321,488, filed Apr. 6, 2010, the disclosure of which is incorporated herein by reference in its entirety.

FIELD OF THE TECHNOLOGY

The present invention relates to microwave cavity filters used in cellular communication systems such as base stations. The present invention further relates to microwave duplexers employing cavity filters and related improved cellular communication systems.

BACKGROUND OF THE INVENTION

As the base stations for the cellular communication systems become smaller and smaller to picocells and femtocells demanding correspondingly smaller electronic components including filters, traditionally bulky filters are also desired to be correspondingly smaller while keeping the performance at optimum levels for blocking unwanted signals which can saturate the low noise amplifier as well as limit transmitted emission level to the FCC specifications. Traditionally, surface mount ceramic block filters have been used in picocell applications but these types of filters suffer from poor rejection (around 50 dB max) and high insertion loss performance limitations.

SUMMARY OF THE INVENTION

In a first aspect the present invention provides a cavity filter, comprising a conductive housing and a hollow conductive body configured within the housing and electrically coupled thereto. The hollow conductive body has a first end coupled to the housing and a second end with a portion folded down toward the first end.

In a preferred embodiment of the cavity filter the hollow conductive body is generally cylindrical in shape and the folded down portion comprises a perimeter section at the cylindrical second end of the hollow conductive body which is an annular folded down region with a generally U shape in cross section. The hollow conductive body preferably has a substantially constant thickness and may be formed by impact, hydra-molding or deep drawn techniques. The housing may include a cover having an opening wherein a conductive adjustable tuning screw is configured in the opening and extends an adjustable distance into the second end of the hollow conductive body. The hollow conductive body may be composed of silver plated stainless steel, copper or brass, for example. The housing may be composed of aluminum, magnesium or silver plated plastic. The tuning screw may be composed of stainless steel or brass. The hollow conductive body has a length dimension and a thickness and the folded portion preferably extends toward the first end by a distance from approximately the hollow conductive body thickness to approximately 50% of the hollow conductive body length. The hollow conductive body may have a thickness from about 0.5 mm to about 1 mm and the cavity filter is resonant in a frequency band at about 700 MHz.

In another aspect the present invention provides a cavity filter, comprising a conductive housing forming a cavity therein and a hollow conductive resonator configured in the cavity within the housing and electrically coupled to the housing. The resonator comprises a first impedance section and a second impedance section, the first impedance section having a first inner dimension and the second impedance section having a second inner dimension greater than the first inner dimension.

In a preferred embodiment of the cavity filter the first inner dimension of the first impedance section is approximately 25% to 40% of the cavity diameter and the second inner dimension of the second impedance section is about 10% to 50% larger than the first inner dimension. The first impedance section is coupled to the housing and the second impedance section has a first end coupled to the first impedance section and a second end which may have a resonator hat portion folded down toward the first end having a generally folded hat shape. The resonator hat diameter is preferably about 20% to 66% larger than the low impedance diameter. In one embodiment the resonator is resonant in the 700 MHz frequency range and has a power capacity of about 25 watts average and the cavity height is approximately 30 mm.

In another aspect the present invention provides a combline microwave cavity duplexer, comprising a conductive housing having a plurality of interconnected cavities, each cavity having a hollow conductive resonator structure configured therein. Each resonator structure has a generally cylindrical shape with a stepped diameter providing first and second diameter sections having different impedance. The duplexer further comprises an input port electrically coupled to the housing for receiving a microwave signal, an output port electrically coupled to the housing for outputting a microwave signal, and a common port electrically coupled to the housing for transmitting and receiving microwave signals.

In a preferred embodiment of the combline microwave cavity duplexer the first diameter section of each resonator is electrically coupled to the housing at a coupled end of the resonator and the second diameter section of each resonator has an open end portion extending outward and folded back toward the coupled end of the resonator. The duplexer preferably further comprises a plurality of adjustable tuning screws extending through the housing into each open end portion of the resonators. The resonators preferably have substantially constant thickness. Each of the resonators folded open end portion preferably extends toward the coupled end thereof by a distance from approximately the resonator thickness to approximately 50% of the resonator length.

Further features and aspects of the invention will be appreciated from the following detailed description.

BRIEF DESCRIPTION OF THE DRAWINGS

FIGS. 4A and 4B generally depict a cross sectional view of a prior art resonator in two embodiments.

FIGS. 6A and 6B generally depicts side and top views, respectively, of an improved microwave combline based duplexer filter in accordance with the invention.

DETAILED DESCRIPTION

In reference with the accompanying figures the present invention will now be described, by way of example, in the best mode contemplated by the inventors for carrying out the present invention. It shall be understood that the following description, together with numerous specific details, may not contain specific details that have been omitted as it shall be understood that numerous variations are possible and thus will be detracting from the full understanding of the present invention. It will be apparent, however, to those skilled in the art, that the present invention may be put into practice while utilizing various techniques.

Prior to describing a preferred embodiment of the invention, the theory of conventional resonator operation will be briefly reviewed.

Figure 7:
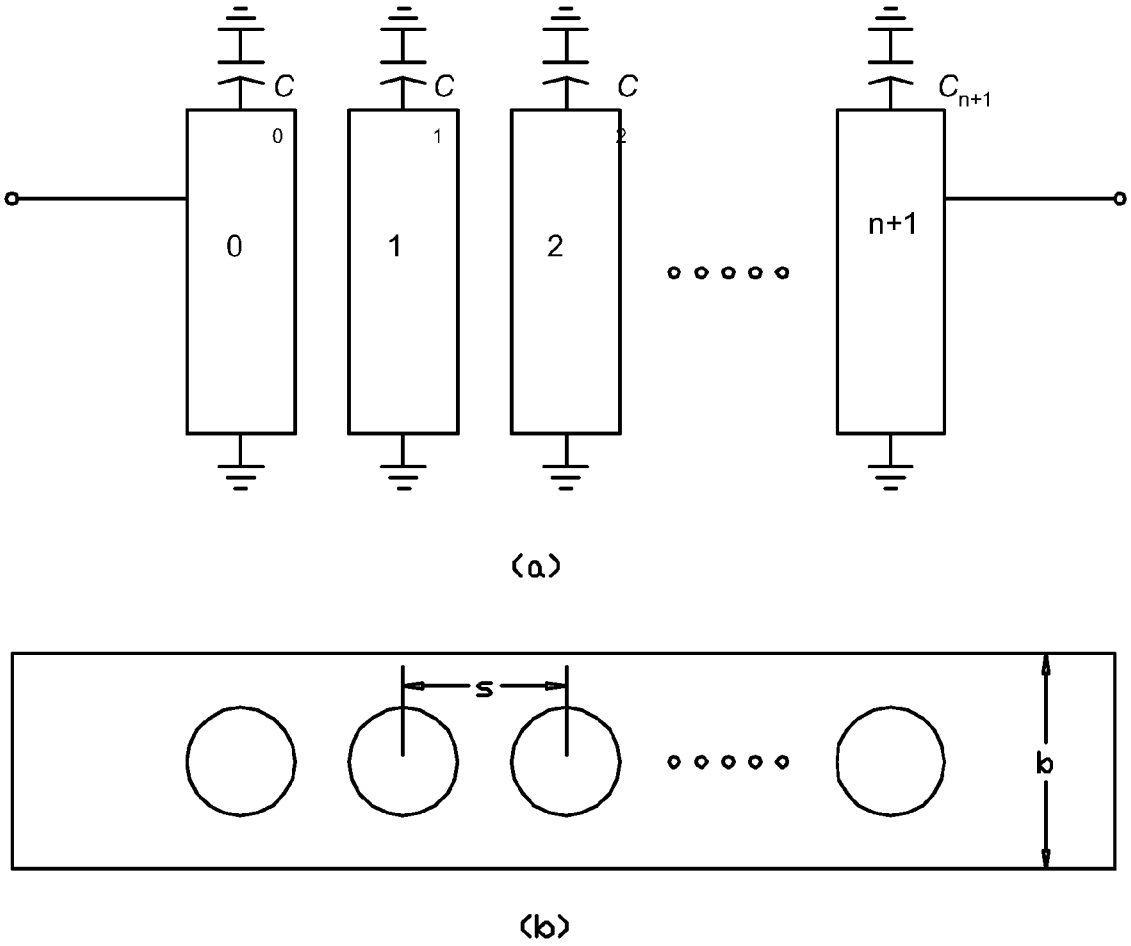
FIG. 7 is a functional schematic drawing of a multi cavity filter ((a) side view (b) top view).

Basic Theory of Combline Filters:

Combline filters as exemplified in FIG. 7, are inductively coupled resonators with electrical length less than 90° which are grounded at one end with capacitive tuning screws giving capacitances CO, CI, C2 . . . Cn+1 for each resonators 0, 1, 2 . . . n+1 respectively for fine adjustment at the other end. The desired performance dictates the number of these resonators used in a particular filter. These resonators may be cross coupled either inductively or coactively for an asymmetric filter response, i.e. having more selective on one side of the pass band than the other side of the pass band. This asymmetric response is more typical in real world applications.

Basic Resonance Theory of Combline Resonators:

The resonance of a combline resonator can be defined as:

$$f = \frac{1}{Z_0 2\pi C \tan(\theta)} \tag{1}$$

Where:

f=resonant frequency of a comb-line resonator $Z_0$=resonator characteristic impedance C=parallel plate capacitance θ=resonator length in radians Looking at equation (1), the resonant the resonant frequency can be lowered by the following:

(1) Increasing the resonator length (2) Increasing resonator impedance (this means increasing the cavity diameter and/or decreasing the resonator diameter)

(3) Increasing end gap capacitance

It can be readily seen that lowering the resonant frequency will lead to a larger geometry. However, if any of the aforementioned parameters could be changed using conventional or non-conventional techniques, the resonant frequency can be lowered. In this invention, the parallel plate capacitance, C is increased by the use of continuously drawn folded resonator hats.

The use of metal combline filters offers tremendous performance advantages due to desired rejection levels as high as even 110 dB or more and they also provide normally lower insertion loss for the same bandwidth conditions. The recently opened 700 MHz band spectrum is lower than the previous lowest band starting in the lower 800 MHz for cellular communications and this lower band corresponds to longer wavelengths and this inherently presents a disadvantage for making smaller filters for the same performance as in the case of higher frequency bands. However, this invention presents a number of new, non-standard techniques to allow the resonators to tune to the appropriate frequency while maintaining the necessary gaps for temperature stability and power handling. These techniques involve a combination of folded hat (FIG. 1), and alternatively or in combination, stepped impedance resonators in a cavity (FIG. 2) with protruded tuning cover (Detail A).

Figure 2:
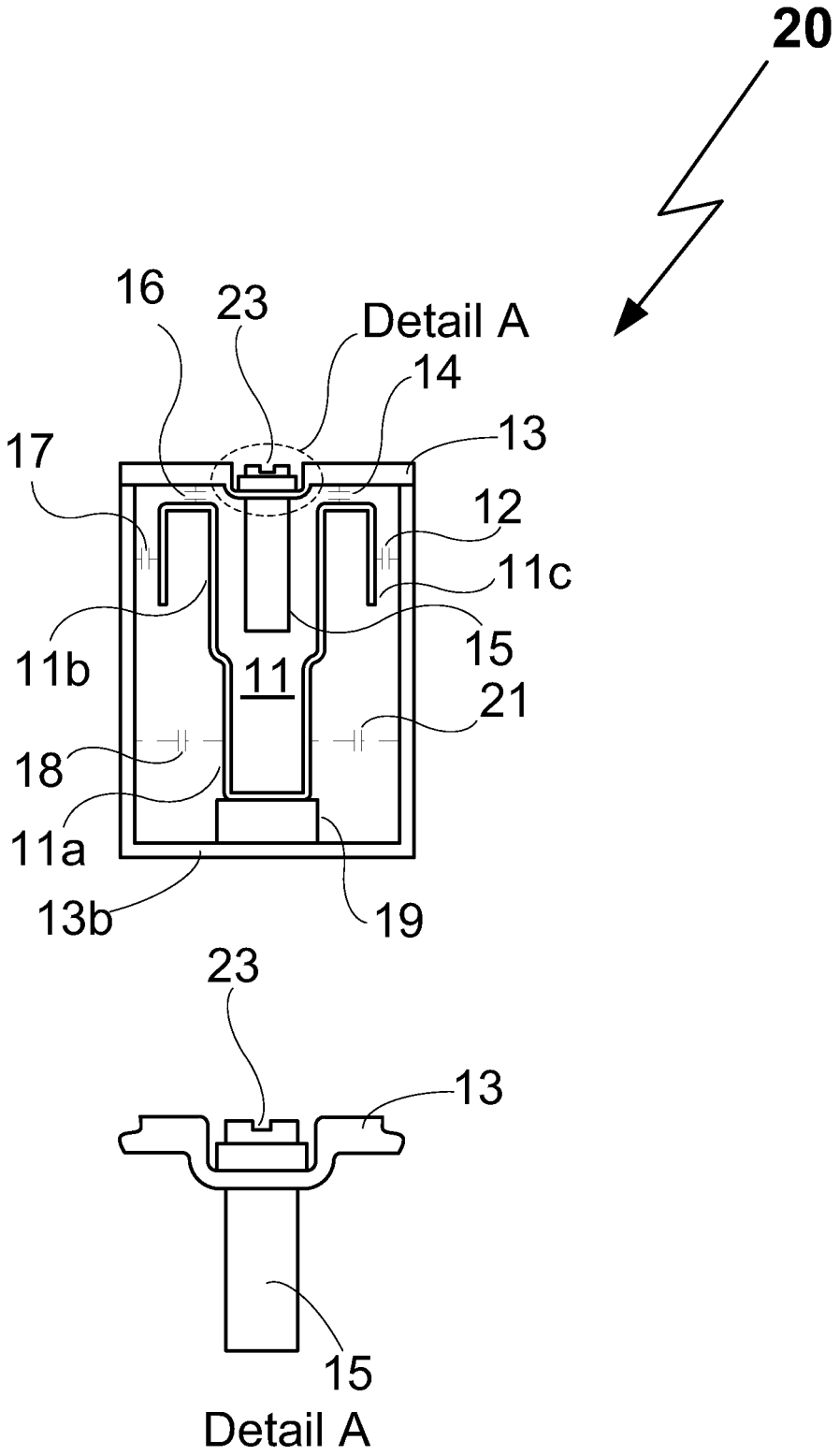
FIG. 2 generally depicts a second embodiment of the invention with a stepped impedance resonator.
Figure 3:
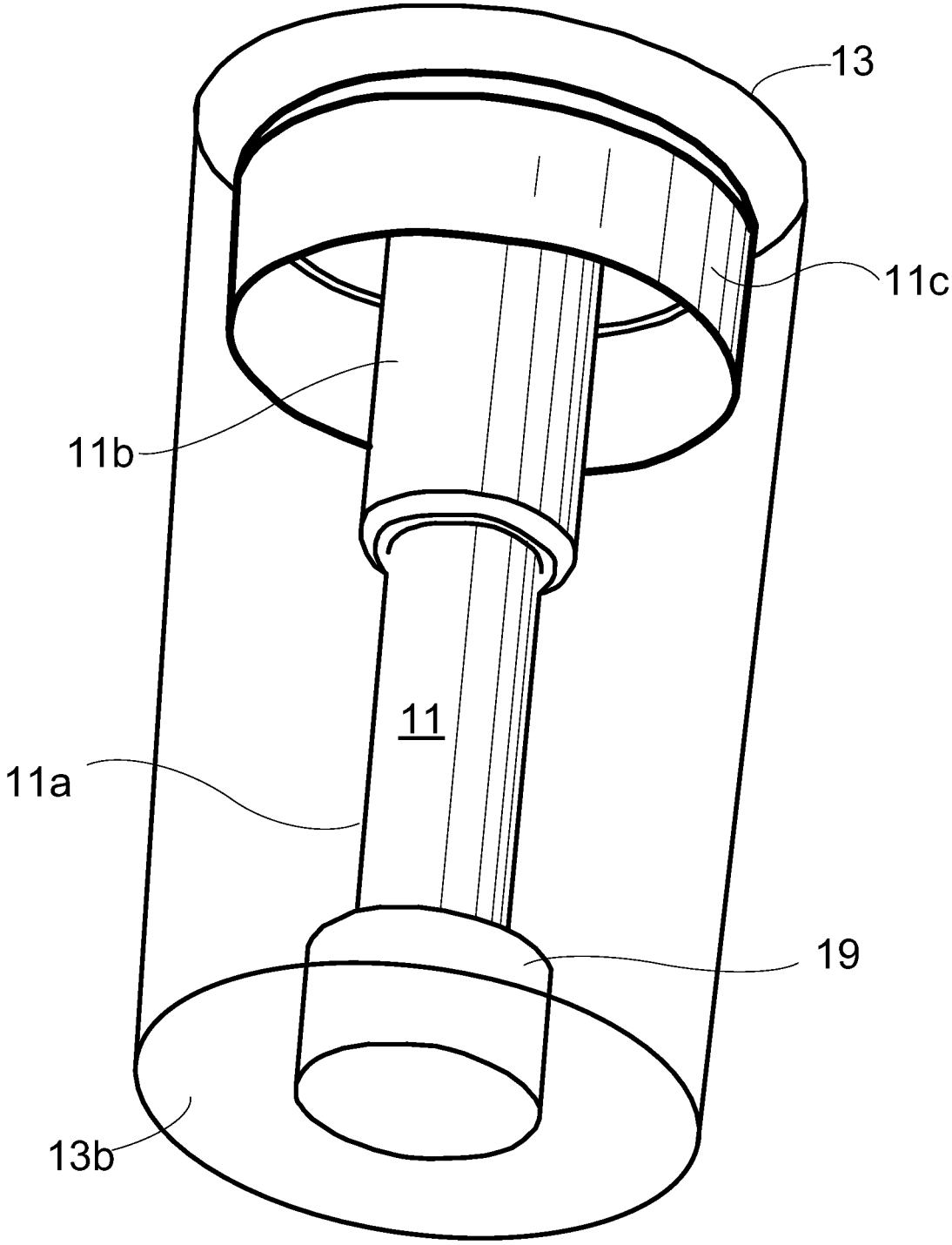
FIG. 3 generally depicts a line 3-D perspective view of the second embodiment of the invention detailing the stepped impedance conductive body of the resonator with key elements identified.

Now with reference to FIGS. 2 and 3, a stepped conductive 11 body is shown. The stepped conductive body has two major length diameter 11*a* and 11*b*. The bottom section 11*a* of the conductive body 11 is used to attach to the pedestal 19. The smaller diameter 11*a* allows for higher impedance which reduces resonant frequency of the cavity. This is highly advantageous when a compact filter size is desired. Additionally, the larger upper 11*b* diameter of the conductive body 11 allows for increased spacing between adjustment screw 15 and conductive body 11. Thus this filter allows greater power handling and temperature compensation capabilities otherwise not afforded by conventional designs.

Figure 1:
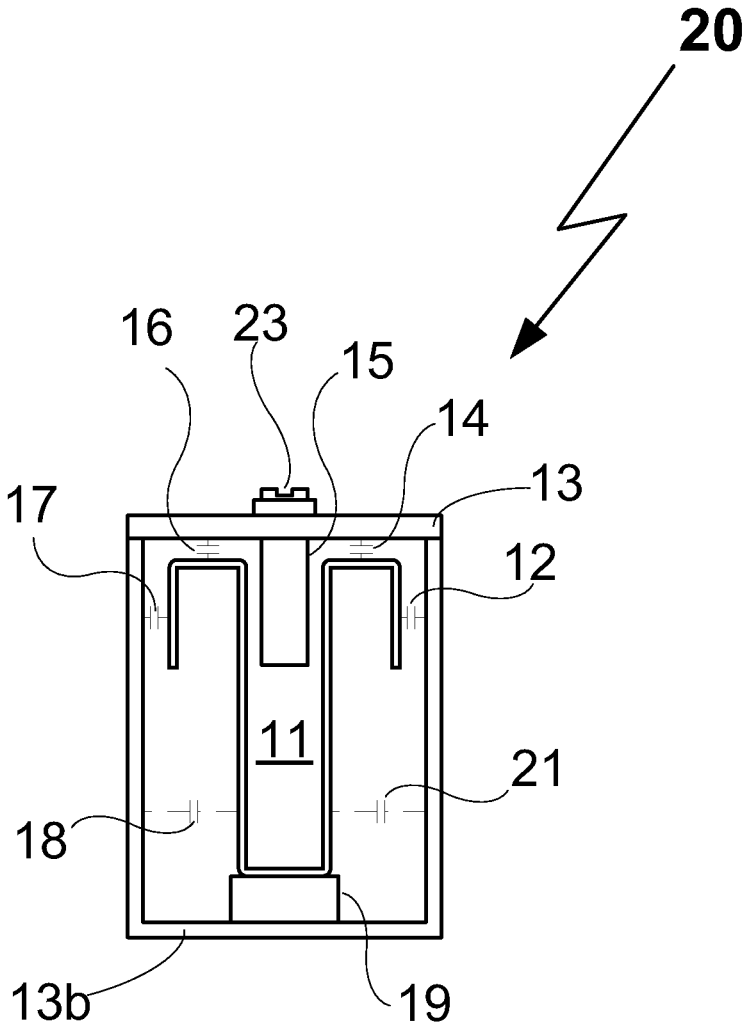
FIG. 1 generally depicts a first embodiment of the invention.

First and second preferred embodiments of the invention are shown in FIGS. 1 and 2. This invention comprises cavity filters which may be part of improved microwave duplexers comprising receive and transmit filters containing resonator cavity filters 20. These embodiments comprise a cavity which has a conductive body 11 grounded at one end by connecting to the metal pedestal 19 which is connected to bottom 13*b* of the main metal housing forming a resonator cavity 20. This pedestal 19 may even be an integral part of bottom 13*b* of the cavity 20. Alternatively, pedestal 19 may be replaced with a recession in the bottom floor 13*b* (i.e. a bore in the housing). In applications that employ an elevated pedestal 19, as shown in FIGS. 1 and 2, the pedestal may have a range of diameters that may be larger or smaller than the conductive body 11 (11*a*) diameter as necessitated by the design. In some applications pedestal 19 may be constructed using materials for temperature compensation of the resonator cavity. The resonator comprises conductive body 11 that has a folded hat (11*b*-11*c*) at one end forming capacitances 14 and 16 to the main cover 13 and additional capacitances 12 and 17. More specifically, the folded hat may comprise a perimeter section which is an annular folded down region at the cylindrical upper end of the hollow conductive body having a generally (inverted) U shape in cross section, as shown. The main cover is connected to the metal housing (not shown) or this cover may even be an integral part of the filter housing. Course resonance is achieved by choosing appropriate dimensions for the cavity size, hat protrusion, resonator diameter, hat diameter and the folded hat length. Alternative forms or partial hat shapes are readily possible. Then, fine tuning adjustment is made by adjusting the protrusion of the tuning screw 15 in to the cavity. The resonator conductive body 11 has a constant wall thickness everywhere which could be formed by impact, hydra-molding or deep drawn techniques. These techniques allow the cavity size to be significantly smaller resulting in much smaller duplexer sizes which have both cost advantages and can be used in applications with space constraints. Suitable materials for the hollow conductive body include silver plated stainless steel, copper or brass. Resonator thickness may be from about 0.5 mm to about 1 mm in one embodiment discussed below. Suitable materials for the housing include aluminum, magnesium or silver plated plastic. Suitable materials for the tuning screw include stainless steel or brass.

With reference to FIGS. 6A and 6B a duplexer for microwave frequencies is generally depicted. As in a conventional duplexer the duplexer has transmitter (TX) port 60, receiver (RX) 50, and common or antenna port 55 where both TX &

RX frequency signals are present. Each of the cavities 20 in turn correspond to the cavity filter design of the present invention as described above. Accordingly, the present invention also provides an improved microwave duplexer.

Each of the above noted design parameters may preferably be optimized for the particular application and performance specifications, including power capability, bandwidth and frequency as well as mechanical and space constraints. The following general design ranges may be employed. The resonator diameter of the high impedance section 11*a* can be approximately 25% to 40% of the cavity diameter. The resonator diameter of the lower impedance section 11*b* can be 10% to 50% larger than the high impedance diameter. The resonator hat diameter could be 20% to 66% larger than the low impedance diameter. The folded down section can be from slightly above the resonator thickness (1% above the resonator thickness to approximately 50% of the total resonator length). The lengths for each of these lower and higher impedance sections would be variable for different performance specifications and mechanical constraints.

As one example of a specific implementation, a prototype duplexer was built using this invention utilizing 6 cavities for the transmit filter and 6 cavities for the receive filter for the 700 MHz band operation to be able to handle 10 Watts of continuous radio frequency power. The total duplexer size achieved for this 700 MHz band was 70 mm width×140 mm length×40 mm height including tuning screws. For this 700 MHz case filter, referring to FIGS. 2 and 3 the following were the dimensions for the cavity and the resonator:

13*b* (Cavity Diameter): 20 mm

19 (Pedestal Diameter and Height): 7 mm diameter and 3 mm height

11*a* (Resonator High Impedance Diameter and Length): 6 mm diameter and 12 mm length

11*b* (Resonator Low Impedance Diameter and Length): 8 mm diameter and 18 mm length

11*c* (Resonator Hat Diameter and Drop Down Length): 17.6 mm diameter and 8 mm length

13 (Cover Thickness): 3 mm

23 (Tuning Screw Diameter and Length): 3 mm diameter and 3-30 mm length for various frequencies in the 700 MHz range.

This invention can lower the overall filter height by as much as 44% from some traditional methods for the same peak and average power handling capability. Using traditional methods for the 700 MHz case, the overall filter height could be as much as 60 to 90 mm with 20 mm diameter cavities, but using this invention the filter height is reduced to 40 mm (cavity height to 30 mm) to handle the same amount of peak power of 25 Watts average and 500 Watts peak.

It will be appreciated that this example is purely one illustration and a variety of specific implementations are possible.

The present invention thus provides a number of advantageous features and has a number of aspects, including:

1. Use of combline cavity duplexers as in a picocell, femto cell and active antenna array communication systems due to significant size reductions.
2. A microwave resonator with its hat folded down with its resonance occurring in the band of operation.
3. A microwave resonator with stepped diameter (to form stepped impedance) and its hat folded down occurring in the band of operation.
4. A constant thickness hollow resonator structure allowing inexpensive manufacturing and forming techniques such as stamping.
5. A cover with protrusion inside the resonant cavity of a tuning screw.

The present invention thus provides improved microwave cavity filters and duplexers used in cellular communication systems such as for example base stations or systems providing Frequency Division Duplexing (FTD) or Time Division Duplexing (TDD) including various sizes of base stations such as macro, pico and femto cells, and integrated active antenna arrays in which all of the transmitting and receiving functionalities are integrated with the antenna patches. This invention especially relates to the integration of combline cavity filters in the LTE pico base stations (picocells) and techniques used for the filter size reductions for the latest 700 MHz band.

Figure 5:
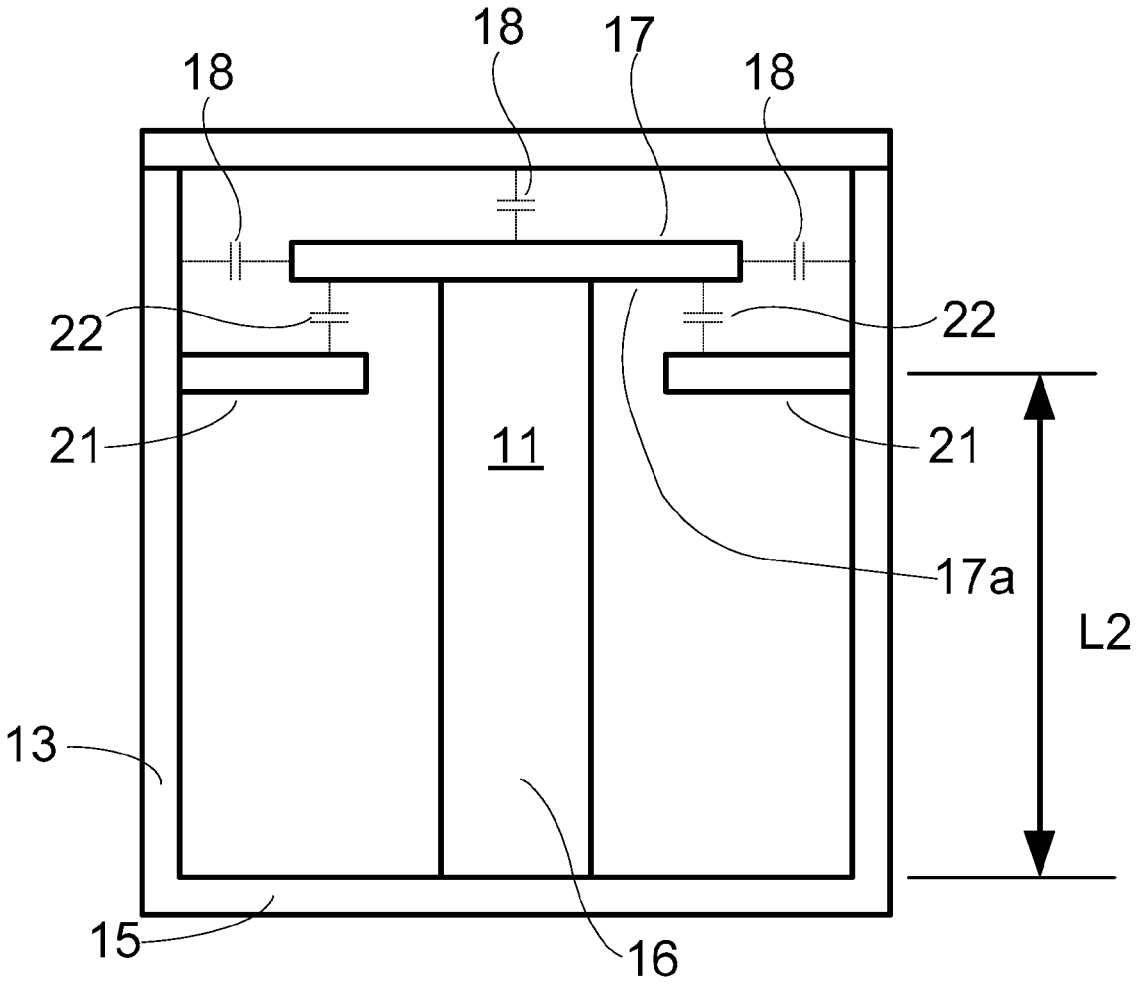
FIG. 5 generally depicts a cross sectional view of the prior art resonator of FIG. 4B with elements identified.

The present invention is an improvement over versions of prior microwave cavity filters represented in FIGS. 4A, 4B and 5, in which a cavity filter 20 includes a conductive body 11 and a cover 13. The conductive body 11 of the prior art does not include a folded over hat as does the conductive body of the embodiments of the present invention shown in FIGS. 1-3 and 6A. The prior filter of FIGS. 4B and 5 includes separate tabs 21 extending inwardly from the interior of housing 15 with the body 11 including a cap 17 at an end opposing its base end 16. The cap 17 establishes impedances 18 with the interior of the housing, and impedances 22 between an underside 17*a* of the cap 17 with the tabs 21, which capacitances reduce filter strength in the frequency band noted.

Further features and aspects of the invention and applications will be readily appreciated by those skilled in the art.

What is claimed is:

1. A cavity filter, comprising:

a conductive housing having a cover; and a hollow conductive body configured within the conductive housing and electrically coupled thereto, the hollow conductive body having a first end coupled to the conductive housing and a second end with a portion folded down toward said first end, wherein the hollow conductive body includes a cavity spaced from and open to the cover of the conductive housing, and wherein said hollow conductive body has a length dimension and a thickness and wherein said folded portion extends toward said first end thereof by a distance from approximately the hollow conductive body thickness to approximately 50% of the hollow conductive body length.

2. The cavity filter of claim 1, wherein said hollow conductive body is generally cylindrical in shape and wherein said folded down portion comprises a perimeter section at the second end of the hollow conductive body which is an annular folded down region with a generally U shape in cross section.

3. The cavity filter of claim 1, wherein said hollow conductive body has a substantially constant thickness.

4. The cavity filter of claim 3, wherein said hollow conductive body is formed by impact, hydra-molding or deep drawn techniques.

5. The cavity filter of claim 1, wherein the cover of said conductive housing includes an opening and wherein a conductive adjustable tuning screw is configured in the opening and extends an adjustable distance into the cavity open to the cover at the second end of said hollow conductive body.

6. The cavity filter of claim 1, wherein said hollow conductive body is composed of silver plated stainless steel, copper or brass.

7. The cavity filter of claim 1, wherein said conductive housing is composed of aluminum, magnesium or silver plated plastic.

8. The cavity filter of claim 5, wherein said tuning screw is composed of stainless steel or brass.

9. The cavity filter of claim 1, wherein said thickness of hollow conductive body is about 0.5 mm to about 1 mm and wherein said cavity filter is resonant in a frequency band at about 700 MHz.

10. A cavity filter, comprising:

a conductive housing forming a cavity therein wherein said conductive housing includes a cover; and a hollow conductive resonator configured in the cavity within the conductive housing and electrically coupled to the conductive housing, the hollow conductive resonator comprising a first impedance section and a second impedance section, the first impedance section having a first inner dimension and the second impedance section having a second inner dimension greater than said first inner dimension of said first impedance section, and wherein the hollow conductive resonator includes at the second impedance section a resonator cavity spaced from and open to the cover of the conductive housing, wherein the first impedance section is coupled to the conductive housing, wherein the second impedance section has a first end coupled to the first impedance section and a second end with a resonator hat portion having a generally folded hat shape folded down toward said first end, and wherein said resonator hat portion includes a dimension that is about 20% to 66% larger than the second impedance section.

11. The cavity filter of claim 10, wherein said hollow conductive resonator is resonant in the 700 MHz frequency range and has a power capacity of about 25 watts average and wherein the resonator cavity height is approximately 30 mm.

12. The cavity filter of claim 10, wherein said first inner dimension of said first impedance section is approximately 25% to 40% of a dimension of the resonator cavity and wherein said second inner dimension of said second impedance section is about 10% to 50% larger than the first inner dimension.

* * * * *